US008172161B2

(12) United States Patent
Biagetti

(10) Patent No.: US 8,172,161 B2
(45) Date of Patent: May 8, 2012

(54) VALVE BODY, FLUID INJECTOR AND PROCESS FOR MANUFACTURING A VALVE BODY

(75) Inventor: Fabrizio Biagetti, Livorno (IT)

(73) Assignee: Continental Automitive Italy S.p.A., Fauglia Pisa (IT)

( * ) Notice: Subject to any disclaimer, the term of this patent is extended or adjusted under 35 U.S.C. 154(b) by 675 days.

(21) Appl. No.: 10/597,510

(22) PCT Filed: Dec. 15, 2004

(86) PCT No.: PCT/EP2004/053474

§ 371 (c)(1),
(2), (4) Date: Aug. 15, 2008

(87) PCT Pub. No.: WO2005/075814

PCT Pub. Date: Aug. 18, 2005

(65) Prior Publication Data

US 2008/0296415 A1 Dec. 4, 2008

(30) Foreign Application Priority Data

Jan. 28, 2004 (EP) ..... 04001801

(51) Int. Cl.
*F02M 61/08* (2006.01)
*F02M 61/00* (2006.01)
*B05B 1/04* (2006.01)

(52) U.S. Cl. ..... 239/533.7; 239/533.12; 239/595; 239/601

(58) Field of Classification Search ..... 239/584, 239/585.1–585.5, 590.3, 595, 601, 602, 533.2–533.12; 29/890.142; 123/299, 446, 447, 467, 468
See application file for complete search history.

(56) References Cited

U.S. PATENT DOCUMENTS

| | | | | |
|---|---|---|---|---|
| 2,338,744 | A * | 1/1944 | Szekely | 239/125 |
| 3,042,317 | A * | 7/1962 | Simmons | 239/453 |
| 3,680,782 | A * | 8/1972 | Monpetit et al. | 239/96 |
| 4,030,668 | A * | 6/1977 | Kiwior | 239/585.4 |
| 4,129,254 | A * | 12/1978 | Bader et al. | 239/96 |
| 4,219,154 | A * | 8/1980 | Luscomb | 239/91 |
| 4,350,301 | A * | 9/1982 | Erwin et al. | 239/453 |
| 4,487,369 | A * | 12/1984 | Du Rocher | 239/488 |
| 4,923,169 | A * | 5/1990 | Grieb et al. | 251/118 |

(Continued)

FOREIGN PATENT DOCUMENTS

DE 3941151 A1 6/1991

(Continued)

OTHER PUBLICATIONS

European Search Report and Written Opinion for European Application No. 04001801.0-2311 (6 pages), Jul. 2, 2004.

*Primary Examiner* — Jason J Boeckmann
*Assistant Examiner* — Justin Jonaitis
(74) *Attorney, Agent, or Firm* — King & Spalding L.L.P.

(57) ABSTRACT

A fluid injector has a housing, an actuator and a valve body. The valve body has a cartridge (21) with a recess, that forms an injection nozzle on one end, and with a needle (22), that is arranged in the recess and closes the injection nozzle, if it rests with its seat area (224) on a needle seat (215) of the cartridge (21). The area (216) of the cartridge (21) adjacent to the needle seat (215) has a cylindrically-shaped outer contour and the needle (22) has a cylindrically-shaped area (223) adjacent to the seat area (224). The area (216) adjacent to the needle seat (215) and the cylindrically-shaped area (223) have the same diameter.

8 Claims, 2 Drawing Sheets

U.S. PATENT DOCUMENTS

| | | | | |
|---|---|---|---|---|
| 5,522,550 | A | 6/1996 | Potz et al. | 239/533.9 |
| 5,755,385 | A * | 5/1998 | Potz et al. | 239/533.2 |
| 5,826,801 | A | 10/1998 | Kobayashi et al. | |
| 5,931,390 | A * | 8/1999 | Hoffmann et al. | 239/562 |
| 5,983,855 | A | 11/1999 | Benedikt et al. | |
| 6,311,950 | B1 * | 11/2001 | Kappel et al. | 251/129.06 |
| 6,460,779 | B1 * | 10/2002 | Boecking | 239/102.2 |
| 7,051,958 | B2 * | 5/2006 | Potz et al. | 239/533.2 |
| 2001/0032893 | A1 * | 10/2001 | Lambert | 239/533.3 |
| 2002/0026923 | A1 | 3/2002 | Bertsch et al. | 123/300 |
| 2003/0025006 | A1 * | 2/2003 | Scarbrough et al. | 239/533.12 |

FOREIGN PATENT DOCUMENTS

| | | | |
|---|---|---|---|
| JP | 1160165 | U | 11/1989 |
| JP | 6220671 | A | 8/1994 |
| JP | 7507614 | T | 8/1995 |
| JP | 8226363 | A | 9/1996 |
| JP | 9177638 | A | 7/1997 |
| JP | 2000500840 | T | 1/2000 |
| JP | 3105244 | B2 | 10/2000 |
| WO | 03/016707 | A1 | 2/2003 |

* cited by examiner

VALVE BODY, FLUID INJECTOR AND PROCESS FOR MANUFACTURING A VALVE BODY

CROSS-REFERENCE TO RELATED APPLICATIONS

This application is a U.S. national stage application of International Application No. PCT/EP2004/053474 filed Dec. 15, 2004, which designates the United States of America, and claims priority to European application number EP04001801.2 filed Jan. 28, 2004, the contents of which are hereby incorporated by reference in their entirety.

TECHNICAL FIELD

The invention relates to a valve body, a fluid injector and a method for producing a valve body. The valve body comprises a cartridge, with a recess that forms an injection nozzle on one end. The valve body further comprises a needle, that is arranged in the recess and closes the injection nozzle, if it rests with its seat area on a needle seat of the cartridge.

BACKGROUND

Fluid injectors, in particular fuel injectors for diesel or gasoline internal combustion engines, comprise a housing, an actuator unit and a valve body. The valve body comprises a needle that opens or closes a nozzle and in that way controls the injection of fuel. In an increasing number of applications actuator units with a piezoelectric actuator are used. They have the advantage of having a very fast response time to actuating signals and enable like that multiple injections into a cylinder of the internal combustion engine during one working cycle of the cylinder. In order to improve the spray characteristics of the fluid injector the fluid pressure is increased. In current gasoline internal combustion engines the fluid injectors are supplied with fuel which has a pressure of up to 200 bars.

WO 03/016707 A1 discloses a fluid injector with a connector to a fuel supply, a housing, an actuator unit, and a valve body. The housing is double tubed and has a recess, which takes up the actuator unit. The actuator unit comprises a piezoelectric actuator, which acts on the needle. Between the walls of the double tube-shaped housing the fuel is led from the connector to a fuel inlet of the valve body. The valve body has a housing part with a recess, that takes up a needle. Depending on the position of the needle a nozzle is opened or closed and respectively fuel is injected or not.

Increasingly strict legislation concerning emissions of internal combustion engines, where a valve body or a fluid injector with valve body is arranged, make it necessary to put a lot of effort in measures, that reduce the emissions. Very important for the prevention of exhaust emissions is, that fluid injectors used for the internal combustion engine have a defined and constant spray characteristic, which is very much the same from one fluid injector to another.

SUMMARY

The object of the invention is to create a valve body, a fluid injector and a method for manufacturing a valve body, which is simple and ensures a defined and constant spray characteristic.

The invention is distinguished by a valve body with a cartridge with a recess, that forms on one end an injection nozzle, and with a needle, that is arranged in the recess and closes the injection nozzle, if it rests with its seat area on an needle seat of the cartridge. The area of the cartridge adjacent to the needle seat has a cylindrically-shaped outer contour and the needle has a cylindrically-shaped area adjacent to the seat area. The area adjacent to the needle seat and the cylindrically-shaped area have the same diameter.

Experiments have surprisingly shown that during a longer period of operation of the valve body a step formation between the cartridge and the needle due to wear is minimized. In this way also a deposit formation is minimized and a constant spray shape during the operation is achieved. In addition to that, the edges formed by the needle seat and the area adjacent to the needle seat of the cartridge and the cylindrically-shaped area adjacent to the seat area and the seat area of the needle are always aligned, even if the valve body is operated with a variable lift.

In an advantageous embodiment of the invention the valve body comprises conically-shaped needle seat and a conically-shaped seat area of the needle. By this an advantageous spray angle can be achieved.

In a further advantageous embodiment of the valve body the cartridge has an area adjacent to the area adjacent to the needle seat where the outer diameter of the cartridge is increasing in the direction away from the nozzle. By this the stability of the cartridge is increased, in particular the stability of the needle seat.

A fluid injector according to the invention is distinguished by a housing, an actuator and the valve body.

The aspect of the invention concerning the method for manufacturing a valve body is distinguished by a valve body with a cartridge with a recess, that forms an injection nozzle on one end, and with a needle, that is arranged in the recess and closes the injection nozzle, if it rests with its seat area on a needle seat of the cartridge. The area of the cartridge adjacent to the needle seat has a cylindrically-shaped outer contour and the needle has a cylindrically-shaped area adjacent to the seat area. The method comprises the steps of inserting the needle in the recess and bringing it to rest with its seat area on the needle seat and grinding the cylindrically-shaped outer contour of the cartridge and cylindrically-shaped area of the needle together. The cylindrically-shaped area of the cartridge adjacent to the needle seat and the cylindrically-shaped area adjacent to the seat area of the needle enable easy control of a constant velocity of the grinding wheel, which rotates parallel to the cylindrically-shaped areas and to the axis of the needle. That way the grinding direction is perpendicular to the surface of the areas which easily enables direct control of the sealing diameter by the grinding process, which is essential for precise control of fluid flow through the injection nozzle.

In an advantageous embodiment of the method for manufacturing the valve body, the grinding includes a honing process. This has the advantage that the diameter of the cylindrically-shaped areas can be adjusted very precisely. It has further the advantage that it enables a very good finish of the surface, which is important for preventing deposit formation.

In a further advantageous embodiment of the method for manufacturing the valve body the grinding includes a lapping process. This enables an excellent finish of the surface, which is important for preventing deposit formation on the surface.

BRIEF DESCRIPTION OF THE DRAWINGS

Exemplary embodiments of the invention are explained in the following with the aid of schematic drawings. These are as follows.

DETAILED DESCRIPTION

Figure 1:
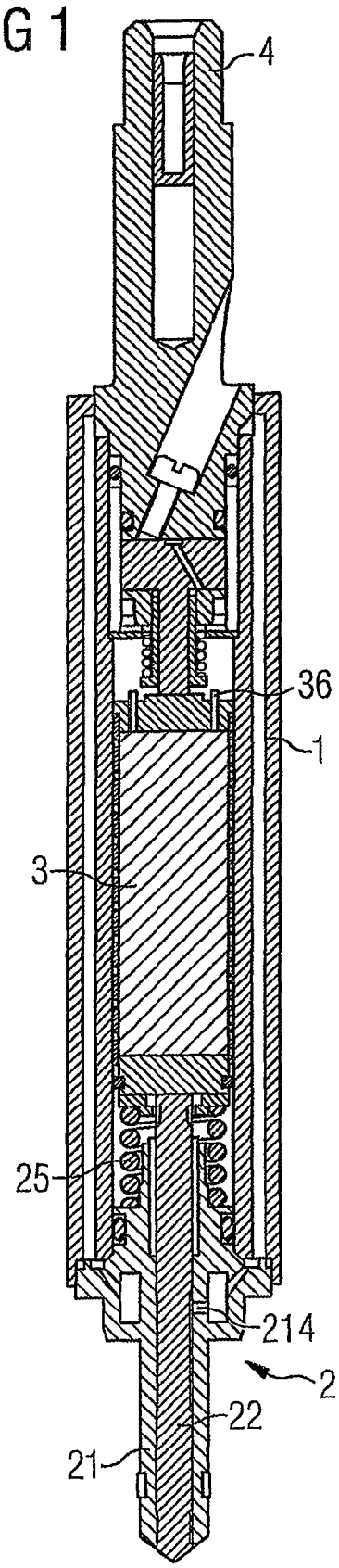
FIG. 1 a fluid injector.

Elements of the same design and function that occur in different illustrations are identified by the same reference character.

A fluid injector, that is used as a fuel injector for an internal combustion engine, comprises a housing 1, a valve body 2, an actuator unit 3 and a fuel connector 4. The fuel connector 4 is designed to be connected to a high pressure fuel chamber of the internal combustion engine, where fuel is stored under high pressure, for example under the pressure of about 200 Bar.

The housing 1 is preferably formed out of a double-tubed housing. In the space between the walls of the double-tubed housing the fuel is led from the fuel connector to a fuel inlet 214 of the valve body 2.

Figure 2:
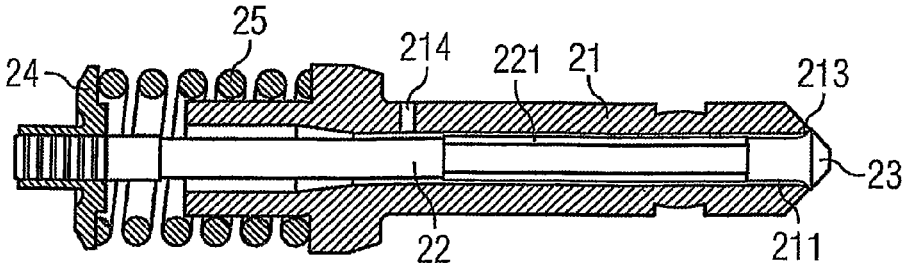
FIG. 2 a valve body.
Figure 3:
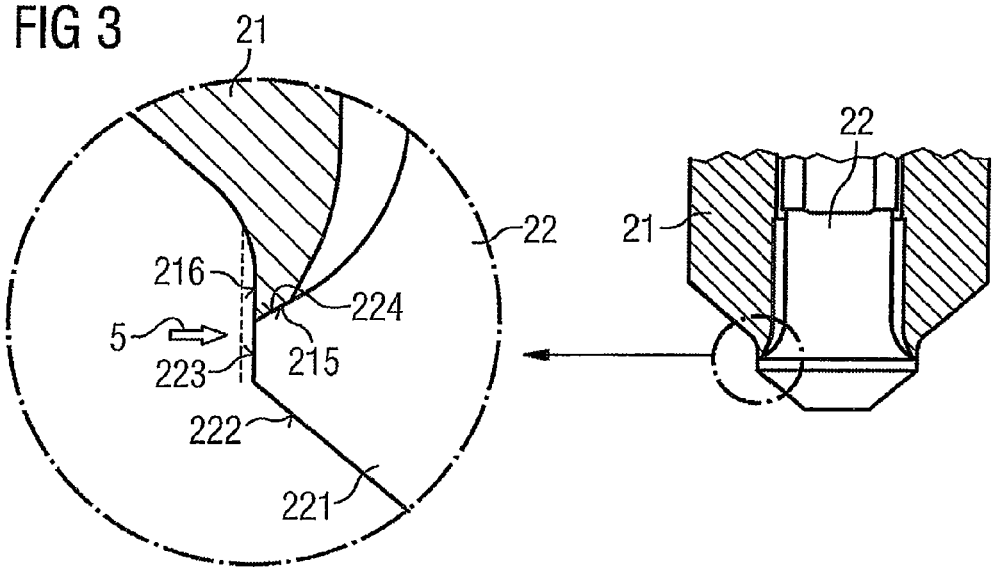
FIG. 3 an enlargement of parts of the valve body.

The valve body 2 comprises a cartridge 21, which is permanently fixed to the housing 1 at one of its free ends, preferably by welding, especially laser-welding. The cartridge 21 comprises a recess 211 (FIG. 2) which forms at one of its ends an injection nozzle 213 and which takes in a needle 22.

A spring rest 24 is connected to the needle 22. A return spring 25 rests on the spring rest 24 and pretensions the needle 22 in a direction away from the injection nozzle 213. In that way the needle 22 closes the injection nozzle 213 with its tip 23, if no further external forces act on the needle 22.

The fuel is led from the fuel inlet 214 in the space between the needle 22 and the wall of the recess 213 of the cartridge 21 to the injection nozzle 213. The needle 22 further comprises a guided zone 221, by which the needle 22 is guided within the recess 213.

In the position where the needle 22 closes the injection nozzle 213 the needle 22 rests with its seat area 224 on a needle seat 215 of the cartridge 21. The needle seat 215 and the seat area 224 are conically shaped in a preferred embodiment. This enables to set a desired spray angle. The area 216 of the cartridge 21 adjacent to the needle seat 215 has a cylindrically-shaped outer contour. The needle 22 has a cylindrically-shaped area 223 adjacent to the seat area 224. The area 216 adjacent to the needle seat 215 and the cylindrically-shaped area 223 have the same diameter. The same diameter is preferably achieved by inserting the needle 22 in the recess 213 of the cartridge and bringing it to rest with its seat area 224 on the needle seat 215. Afterwards the cylindrically-shaped outer contour of the cartridge 21 and cylindrically-shaped area 223 of the needle are grinded together. During the grinding process material is cut-off in the grinding direction 5, which is perpendicular to the surface of the cylindrically-shaped areas 216 and 223 and which is perpendicular to the axis of the needle 22, which makes it easy to control a constant velocity of the grinding wheel over the whole surface of the cylindrically-shaped area 216 and 223. In that way the sealing diameter which corresponds to the diameter of the cylindrical surfaces 216 and 223 can be precisely controlled.

The grinding process preferably includes a honing process and/or a lapping process. In the honing process the grinding wheel makes, for example an axial oscillatory movement parallel to the axis of the needle 22 and the needle and the cartridge are turned around their axis. For the lapping process a paste or fluid is used which contains the cutting material.

The area of the cartridge adjacent to the area 216 to the needle seat 224 has preferably an outer diameter of the cartridge 21 which is increasing in the direction away from the injection nozzle 213. By this the stability of the cartridge 21 is improved, in particular the stability of the needle seat 224.

What is claimed is:

1. A valve body comprising a cartridge with a recess that forms an injection nozzle on one end and a needle that is arranged in the recess and closes the injection nozzle if a seat area of the needle rests on a needle seat of the cartridge, wherein an area of the cartridge adjacent to the needle seat has an inner diameter contour and a cylindrically-shaped outer diameter contour, and the needle has a cylindrically-shaped area adjacent to the seat area, wherein the cylindrically-shaped outer diameter contour of the cartridge adjacent to the needle seat and the cylindrically-shaped area of the needle have the same outer diameter, wherein a cross-section the inner diameter contour of the cartridge adjacent the needle seat is curved such that an inner diameter of the cartridge gradually increases in a downstream direction, wherein a cross-section an outer diameter contour of the needle upstream of the cylindrically-shaped area of the needle is curved such that an outer diameter of the cartridge gradually increases in the downstream direction, and wherein in a closed position, the seat area of the needle rests directly on the needle seat of the cartridge.

2. A valve body according to claim 1, wherein the needle seat and the seat area of the needle are conically shaped.

3. A valve body according to claim 1, wherein the cartridge has an area adjacent to the area adjacent to the needle seat wherein the outer diameter of the cartridge is increasing in the direction away from the injection nozzle.

4. A fluid injector with a housing, an actuator unit and a valve body according to claim 1.

5. A valve body comprising:

a injection nozzle comprising a recess, and a needle arranged within the recess and being operable to close the injection nozzle when a seat area of the needle rests on a needle seat of the injection nozzle, wherein an area of the injection nozzle adjacent to the needle seat has an inner diameter contour and a cylindrically-shaped outer diameter contour, and the needle has a cylindrically-shaped area adjacent to the seat area, wherein the cylindrically-shaped outer diameter contour of the injection nozzle adjacent to the needle seat and the cylindrically-shaped area of the needle have the same outer diameter, wherein a cross-section the inner diameter contour of the cartridge adjacent the needle seat is curved such that an inner diameter of the cartridge gradually increases in a downstream direction, wherein a cross-section an outer diameter contour of the needle upstream of the cylindrically-shaped area of the needle is curved such that an outer diameter of the cartridge gradually increases in the downstream direction, and wherein in a closed position, the seat area of the needle rests directly on the needle seat of the cartridge.

6. A valve body according to claim 5, wherein the needle seat and the seat area of the needle are conically shaped.

7. A valve body according to claim 5, wherein the injection nozzle comprises an area adjacent to the area adjacent to the needle seat wherein the outer diameter of the injection nozzle is increasing in the direction away from the injection nozzle.

8. A fluid injector with a housing, an actuator unit and a valve body according to claim 5.

* * * * *